US005671885A

United States Patent [19]

Davisson

[11] Patent Number: 5,671,885

[45] Date of Patent: Sep. 30, 1997

[54] NUTATING SPRINKLER WITH ROTARY SHAFT AND SEAL

[75] Inventor: Paul D. Davisson, Walla Walla, Wash.

[73] Assignee: Nelson Irrigation Corporation, Walla Walla, Wash.

[21] Appl. No.: 575,734

[22] Filed: Dec. 18, 1995

[51] Int. Cl.[6] ..... B05B 3/06

[52] U.S. Cl. ..... 239/222.17; 239/229; 239/588

[58] Field of Search ..... 239/214, 222.11, 239/222.17, 222.21, 229, 251–253, 381–383, 587.1, 588, DIG. 1, 519; 403/122, 220, 291

[56] References Cited

U.S. PATENT DOCUMENTS

| | | | |
|---|---|---|---|
| 928,372 | 7/1909 | Fisher . | |
| 2,151,214 | 3/1939 | Kramer | 239/587.1 X |
| 2,639,191 | 5/1953 | Hruby, Jr. | 239/222.17 |
| 2,848,276 | 8/1958 | Clearman | 239/62 |
| 2,963,228 | 12/1960 | Hait . | |
| 3,009,647 | 11/1961 | Hait . | |
| 3,009,648 | 11/1961 | Hait | 239/201 |
| 3,034,728 | 5/1962 | Hruby, Jr. | 239/206 |
| 3,312,400 | 4/1967 | Clearman | 239/222.21 |
| 3,428,256 | 2/1969 | Painter . | |
| 3,532,273 | 10/1970 | Siddall et al. | 239/222.17 |
| 3,664,585 | 5/1972 | Curtis . | |
| 3,759,445 | 9/1973 | King . | |
| 4,073,438 | 2/1978 | Meyer | 239/237 |
| 4,290,557 | 9/1981 | Rosenberg | 239/222.21 |
| 4,398,666 | 8/1983 | Hunter | 239/222.13 |
| 4,487,368 | 12/1984 | Clearman | 239/222.17 |
| 4,660,766 | 4/1987 | Nelson et al. | 239/222.17 |
| 4,796,811 | 1/1989 | Davisson | 239/222.17 |
| 4,836,449 | 6/1989 | Hunter . | |
| 5,086,842 | 2/1992 | Cholet | 166/312 |
| 5,224,653 | 7/1993 | Nelson et al. | 239/222.17 |
| 5,381,960 | 1/1995 | Sullivan et al. | 239/222.21 |
| 5,439,174 | 8/1995 | Sweet | 239/222.17 |
| 5,588,595 | 12/1996 | Sweet et al. | 239/222.17 |

FOREIGN PATENT DOCUMENTS

| | | |
|---|---|---|
| 54127 | 9/1975 | Australia . |

*Primary Examiner*—Lesley D. Morris
*Attorney, Agent, or Firm*—Nixon & Vanderhye P.C.

[57] ABSTRACT

A nutating sprinkler includes a body portion having a nozzle at one end and a spray plate supported thereon at an opposite end downstream of the nozzle. The spray plate has a plurality of stream distributing grooves formed on one side thereof configured to cause the spray plate to rotate when struck by a stream emitted from the nozzle. The spray plate also includes a flexible connector coupling the spray plate to a free end of a first rigid shaft seated in a housing at the opposite end, such that the spray plate is caused to wobble about a common center of motion as it rotates.

16 Claims, 2 Drawing Sheets

NUTATING SPRINKLER WITH ROTARY SHAFT AND SEAL

TECHNICAL FIELD

This invention relates to sprinkler devices and more specifically, to an improved sprinkler which incorporates a spray plate mounted for wobbling/rotating motion referred to herein as "nutation".

BACKGROUND

Micro sprinkler irrigation is becoming more popular as water becomes more scarce. The energy cost to operate a micro sprinkler is typically less than full-sized sprinkler systems due to lower pressure requirements.

Two common types of micro sprinklers are as micro spray and a micro spinner, both of which are designed for low application rates which allow for better soil penetration and less runoff.

Micro spray emitters are characterized by wetted spokes radiating from the emitter. The spray-type emitters typically have 70–75 percent of the area within the coverage diameter receiving little or no wetting. In contrast, the spinner-type emitters (which have moving parts) have much higher distribution uniformities with most of the wetted area (diameter) receiving suitable mounts as of wetting. The higher the water pressure, the higher the distribution uniformity will typically be for both types of emitters. Operation of spinners at low pressure (15 psi) generally results in a doughnut type of distribution pattern which is common to high-pressure sprinklers operated at too low a pressure unlike the proposed invention.

The purpose of this invention is to provide better distribution uniformity and larger wetted diameter at low pressure as compared to current sprinklers whether it be for a low-energy pivot system or a micro-irrigated orchard.

Moving irrigation systems, such as conventional pivot move (or center pivot) and lateral (or linear) move systems, are known to incorporate conduit truss span assemblies which mount sprinkler heads, spaced along the tress assemblies for sprinkling or irrigating relatively large areas of land. The sprinkling heads may be mounted on top of the truss assemblies in a normal upright position, or they may be inverted and suspended from the span assemblies by means of drop tubes. The sprinkler heads are typically of the spinner type, which incorporate rotatable stream distributors (also referred to as rotor plates or spray plates), fixed spray plates or bubbler devices.

When irrigating large areas of land with center pivot or linear systems, the sprinklers need to be spaced apart as far as possible to minimize system hardware costs. To obtain an even distribution of the water at wide spacings requires sprinklers that simultaneously throw the water long distances and produce sprinkling patterns that are very even when overlapped with adjacent sprinklers. These two requirements are somewhat exclusive in that maximum radius of throw is achieved with concentrated streams of water shooting at a relatively high trajectory angle (approximately 20° up from horizontal); however, as already noted, these streams tend to produce a "donut" shaped sprinkling pattern at low pressure that does not overlap evenly.

In commonly owned U.S. Pat. No. 5,439,174 and commonly owned copending application Ser. No. 08/446,099, there are disclosed nutating sprinklers which include rotatable spray plates mounted on nutating shafts. While this arrangement is effective in terms of achieving the desired nutating movement, it is difficult to seal the nutating shaft so as to prevent debris from entering into the bearing area of the shaft.

DISCLOSURE OF THE INVENTION

It is the principal objective of this invention to provide an improved shaft/bearing arrangement in a spinner type sprinkler, and which includes a more consistent sealing arrangement. More specifically, the spray plate which distributes a stream emitted from a fixed nozzle is mounted on a rotary shaft by means of a flexible coupling fixed at one end to the spray plate and at the other end to the rotating shaft. The distribution grooves are formed on the spray plate so that the water stream which exits the nozzle and impacts the rotor plate, causes it to rotate and wobble (oscillate with an off-center motion) about a common center of motion. This motion is referred to herein as "nutation". In this arrangement, the rotary shaft simply rotates about its own axis, while the wobbling movement of the spray plate is accommodated in the flexible coupling. An annular lip seal on the rotary shaft is all that is required to effectively preclude movement of debris past the seal into the shaft bearing or mounting arrangement.

As the emitted stream causes the spray plate to nutate, the base of the spray plate (which defines a rotor surface) engages a surface of the sprinkler body (which defines a stator surface) and rolls and slips about the stator surface, in continuous contact therewith. The combination of rolling and slipping of the spray plate forces random droplet distribution which enhances the overall uniformity of the wetted pattern.

In addition, the flexible coupling between the spray plate and the fixed shaft has inherent resilience which, in its natural state, brings the spray plate to a vertical position when not in use. This feature enhances the wear life of the stator surface on the sprinkler body due to reduced forces of the rotor plate on the stator surface.

Accordingly, in its broader aspects, the invention relates to a sprinkler comprising a body portion supporting a nozzle and a rotatable spray plate in axially spaced relationship to the nozzle, the spray plate having a flexible coupling projecting therefrom and secured to one end of a relatively rigid shaft mounted in a housing located downstream of the nozzle.

In another aspect, the invention relates to a sprinkler comprising a body portion having a nozzle at one end and a spray plate supported thereon at an opposite end downstream of said nozzle, the spray plate having a plurality of stream distributing grooves formed on one side thereof configured to cause the spray plate to rotate when struck by a stream emitted from the nozzle; and wherein the spray plate includes a flexible connector coupling the spray plate to a free end of a first rigid shaft seated in a housing at the opposite end, such that the spray plate is caused to wobble about a common center of motion as it rotates.

Additional objects and advantages of the invention will become apparent from the detailed description which follows.

DETAILED DESCRIPTION OF THE DRAWINGS

Figure 1:
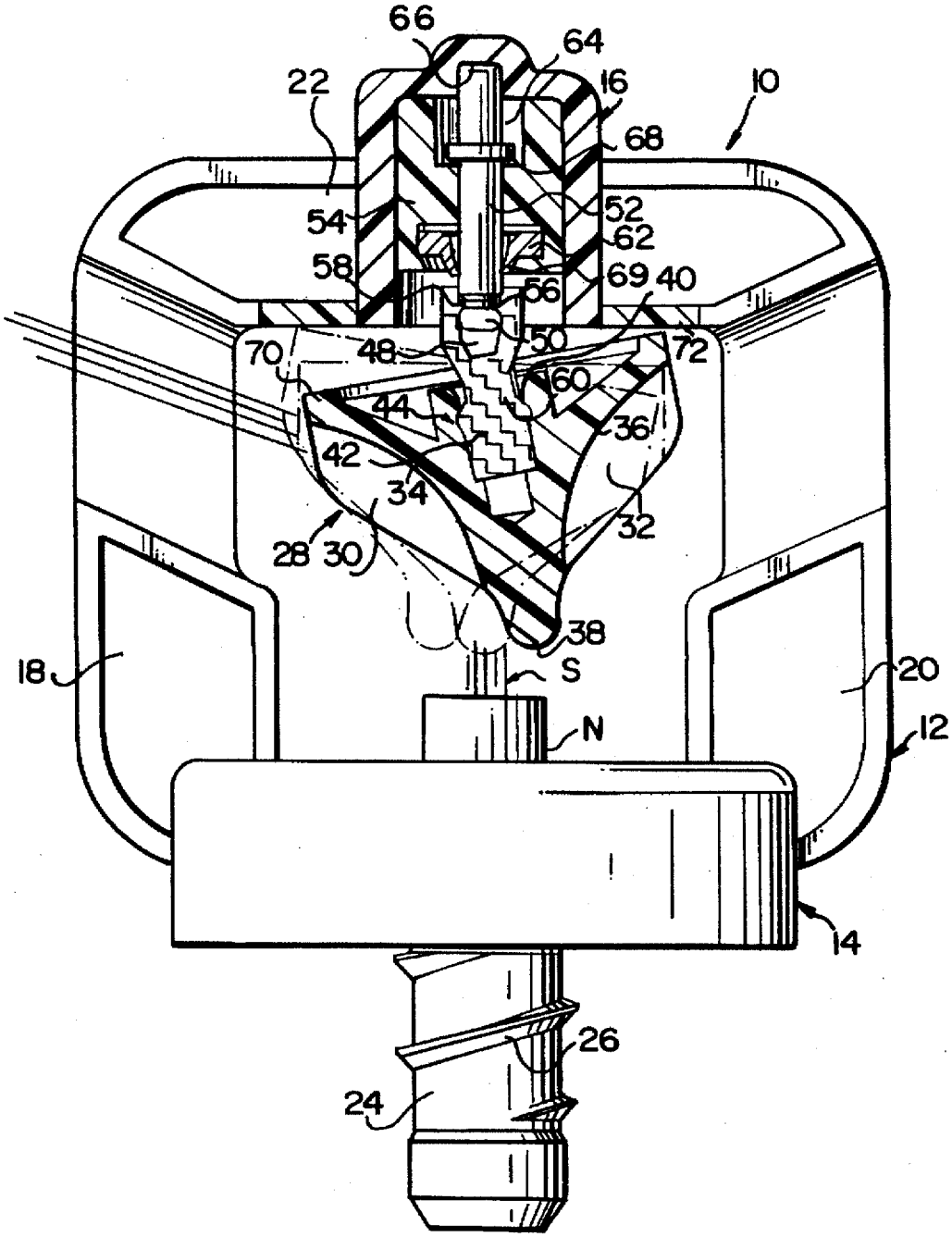
FIG. 1 is a side elevation, partly in section, illustrating a sprinkler incorporating a nutating spray plate in accordance with an exemplary embodiment of the invention.

With reference to FIG. 1, the nutating sprinkler 10 in accordance with this invention includes generally, a sprinkler body 12 which includes a nozzle housing 14 at one end of the sprinkler body, and a spray plate support housing 16 at an opposite end of the sprinkler body. A pair of vertical webs 18 and 20 extend upwardly in laterally spaced relation from the nozzle housing 14 connected by an upper horizontal bridge portion 22, with the spray plate housing 16 secured centrally within the bridge portion 22, in vertical alignment with the nozzle housing 14.

The nozzle housing 14 is provided with an inlet coupling 24 which includes, in the exemplary embodiment, a screw thread 26 adapted to engage a similarly threaded end of a water supply hose or tube. A nozzle N is secured within the housing 14 in such a way as to direct a stream S of water in a vertically upward direction. A spray plate 28 is supported by the housing 16, also in substantially vertical alignment with the nozzle N, so that a stream S emitted from the nozzle impinges on the spray plate 28 in a manner described in greater detail below.

The spray plate 28 is formed with a plurality of curved stream distribution grooves, two of which are shown at 30 and 32, and it will be appreciated that these grooves have a circumferential component which causes the spray plate 28 to rotate when struck by the stream S. The groove configuration is conventional and, by itself, is not part of this invention. The base 34 of groove 30 and base 36 of groove 32 (and similar structure in the remaining grooves) also redirect the stream S from vertical to substantially radial outwardly as indicated in the Figure. The spray plate 28 in the exemplary embodiment is preferably a plastic member and is generally (but not necessarily) conical in shape, with a rounded nose 38 normally aligned with a vertical axis extending through the nozzle N. The spray plate has a rear face formed with a bore 40 counterbored to receive one end of a flexible shaft or coupling 42. The counterbore and the flexible shaft or coupling are shaped to provide mating groove/detent surfaces indicated by reference numeral 44 which serve to retain the flexible shaft or coupling 42 within the bore 40 of the spray plate 28.

The other end of the flexible shaft or coupling 42 is formed with an open ended recess 48 which receives a free end 50 of a rigid shaft 52 which, in turn, is received within a cylindrical bearing insert 54 secured within housing 16. The free end of the shaft 52 includes a head and a reduced diameter section or neck 56, and this free end portion of the shaft 52 cooperates with a radially inwardly directed flange 58 within the recess 48 of the coupling 42 for the purpose of retaining the flexible shaft or coupling 42 on the rigid shaft 52. Note that between the two opposite ends of the flexible coupling or shaft 42, there is a reduced diameter portion 60 which allows the spray plate 28 to wobble more effectively as it rotates, as further explained below.

The rigid shaft 52 is mounted in the cylindrical bearing insert 54 which is, in turn, friction fit or otherwise appropriately secured within the housing 16. The bearing insert 54 is counterbored at one end to receive an annular lip seal 62. The other end of the bearing insert 54 is counterbored at 64, where the shaft 52 extends through the bearing and into a seat 66 formed in the housing 16. A radial flange 68 on the shaft 52 insures that the shaft will not slide out of the bearing insert 54. It will be appreciated that the rigid shaft 52 is substantially free to rotate relative to both the bearing insert 54 and the housing 16. Alternatively, the shaft 52 may be mounted within the housing 16 in a viscous brake arrangement of the type described in commonly owned U.S. Pat. No. Re. 33,823, incorporated herein by reference. In this case, the degree of braking may be varied as desired. It should also be appreciated that the shaft 52 may be fixed within the housing 16 in a stationary manner (non-rotating) for situations where it is desirable to have the spray plate 28 simply wobble about the shaft axis by reason of the flexibility of the shaft or coupling 42.

The seal 62 includes a forwardly projecting annular lip 69 which serves to prevent debris from entering into the bearing insert 54 and/or housing 16. The seal 62 is preferably rubber but could also be plastic or other suitable material.

In use, as the stream S is emitted from the nozzle N, it impinges on the rounded nose 38 of the spray plate 28 and is distributed by means of the grooves 30 and 32 (and similar grooves not visible in the Figure) such that the spray plate 28, coupling 42 and shaft 52 are caused to rotate. At the same time, the flexible shaft or coupling 42 will cause the spray plate 28 to wobble about the longitudinal axis of the sprinkler (which passes through the nozzle N and rigid shaft 52) which also provides a common center of motion. This nutating action is enhanced by the reduced diameter portion 60 of the flexible shaft or coupling 42. As the spray plate 28 nutates about the common center of motion corresponding to the longitudinal axis of the sprinkler, an annular rotor surface 70 on the spray plate 28 engages an annular stationary stator surface 72 or plate on the underside of the bridge 22, surrounding the housing 16. It will be understood that the spray plate 28 will roll and slip about the stator surface 72 and the slippage results in a random droplet distribution which enhances the overall uniformity of the wetted pattern.

It will be appreciated that the flexible shaft or coupling 42 may be rubber or plastic, and my also take the form of a metal coil spring or other flexible connecting or coupling mechanism. In addition, the means by which the flexible shaft or coupling is fixed to the spray plate and to the rigid shaft may vary as well.

Figure 2:
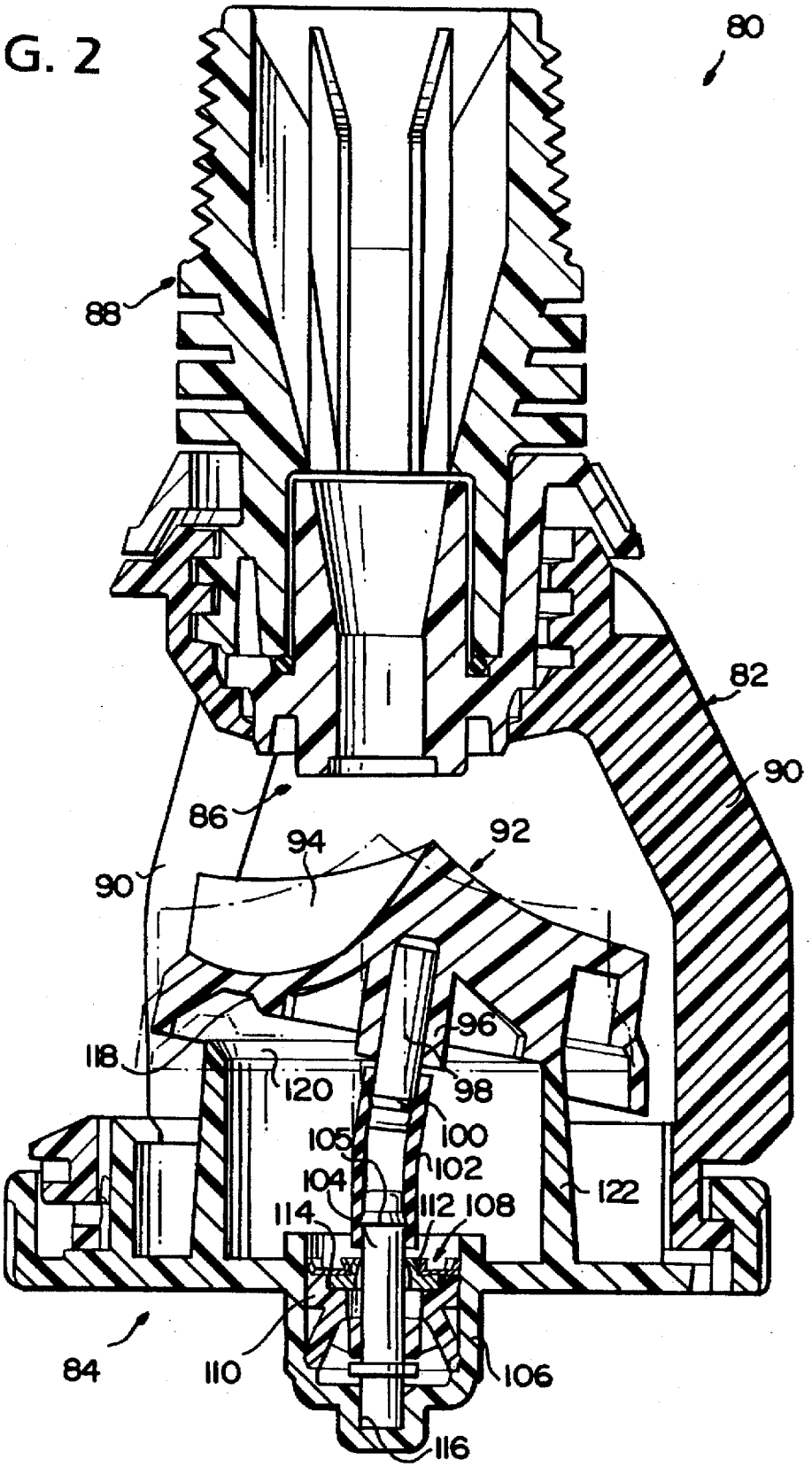
FIG. 2 is a side elevation, partly in section, of another sprinkler incorporating a nutating spray plate in accordance with the invention.

Turning now to FIG. 2, another embodiment of the invention is illustrated at 80 and includes generally a sprinkler body 82, a removable cap assembly 84, a nozzle 86 and a connector/adaptor 88. The cap assembly 84 is an easily removable, positive latch type cap of the type disclosed in commonly owned U.S. Pat. No. 5,409,168, incorporated herein by reference. The nozzle 86 is of the easily removable, modular kind, as disclosed, for example, in commonly owned U.S. Pat. No. 5,415,348.

The cap assembly 84 which is supported on a plurality of struts 90 (three equally spaced struts are employed, but only two are shown in FIG. 2) is modified in this application however, to accommodate a rotor or spray plate 92 which redirects in a substantially radial direction, a stream issuing from the nozzle 86 by reason of the multi-groove configuration formed in the plate. The spray plate 92, like the previously described spray plate 28, is formed with a plurality of curved stream distribution grooves, one of which is shown at 94, which also have a circumferential component which causes the spray plate 92 to rotate when struck by the stream emitted from the nozzle 86. The grooves also serve to redirect the stream from vertical to substantially radially outward in substantially the same manner as described in connection with the first mentioned embodiment illustrated in FIG. 1.

The spray plate 92 has a rear face formed with an annular bushing 96 projecting rearwardly in a direction opposite the front face of the spray plate, the bushing receiving a fixed stub shaft 98 formed at its free end with a tapered radial flange 100. A flexible rubber tube or coupling 102 is telescoped over the free end of the fixed stubshaft 98 with the flange 100 serving to maintain the tube or coupling 102 on the fixed shaft 98. The other end of the flexible tube or coupling 102 is telescoped over one end of a second stub shaft 104 mounted within a shaft housing 106 integrally formed with the cap assembly 84. The seal 108 is formed with an annular lip 112 similar to that in the first described embodiment. A tapered, radial flange 105 on shaft 104 retains the coupling 102 in the same manner as flange 100 on shaft 98. Thus, the flexible tube or coupling 102 serves as a connector between stub shaft 98 and stub shaft 104. The shaft 104 passes through an annular seal 108 seated within a bearing 110 friction fit (or otherwise suitably secured) within the housing 106. The seal 108 is formed with an annular lip 112 similar to that in the first described embodiment. Here, however, a retaining ring or clip 114 is employed to hold the seal 108 in place. The other end of the shaft 104 is received in a seat 116 formed in the housing 106. It will be appreciated that there is sufficient clearance between the shaft 104, bearing 110 and housing 106 so that the shaft 104 can essentially spin freely as dictated by rotation of the spray plate 92.

The rear face of the spray plate 92 is formed with an annular, beveled rotor ring surface 118 which is designed to engage an annular, similarly beveled stator surface 120 formed at the free end of a hollow sleeve 122 centrally located within the cap assembly 84 and projecting towards the nozzle 86. In other words, the sleeve 112 is concentric with the longitudinal axis of the sprinkler body which extends through the nozzle and through the stub shaft 104.

With the above described arrangement, as the stream impinges on the spray plate 92 causing the latter to wobble and rotate about the longitudinal axis, i.e., nutate, the rotor surface 118 engages the stator surface 120 as shown in FIG. 2. The rotor surface 118 will roll and slip about the stator surface in much the same manner as in the first described embodiment, to again insure random droplet distribution and overall uniformity of the wetted pattern.

In connection with the above operation, it will be appreciated that the rubber tube or coupling 102 is free to nutate about the longitudinal axis of the sprinkler not only by reason of the inherent flexibility of the rubber material, but also by reason of the axially spaced relationship between the stub shafts 98 and 104.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler comprising a body portion supporting a nozzle and a rotatable spray plate in axially spaced relationship to said nozzle, said spray plate having a flexible coupling projecting therefrom and secured to one end of a relatively rigid shaft mounted in a housing located downstream of said nozzle.

2. The sprinkler of claim 1 wherein said spray plate is formed with a plurality of grooves shaped to cause said spray plate to rotate when engaged by a stream emitted from said nozzle, and to redirect said stream from a vertical orientation to a substantially horizontal, radially outward orientation, wherein said flexible coupling and said plurality of grooves cause said spray plate to wobble as it rotates.

3. The sprinkler of claim 2 wherein said spray plate is provided with an annular rotor surface and said body portion is provided at said opposite end with an annular stator surface engageable with said annular rotor surface such that a portion of said rotor surface moves about said annular stator surface in continuous contact therewith as said spray plate wobbles and rotates.

4. The sprinkler of claim 3 wherein said rotor surface slips and rolls on said stator surface such that as said spray plate rotates and wobbles, a random droplet distribution is achieved which enhances uniformity of the wetted area.

5. The sprinkler of claim 1 wherein said flexible coupling includes a tubular first end telescoped over a free end of said rigid shaft.

6. The sprinkler of claim 1 wherein said rigid shaft passes through a bearing insert in said housing, and further wherein an annular seal is seated within said bearing insert, said seal having an aperture for receiving said rigid shaft and an annular lip projecting in a direction toward said spray plate.

7. The sprinkler of claim 1 wherein said flexible coupling comprises a rubber shaft and wherein said rigid shaft and said rubber shaft have cooperating means for retaining said rubber shaft on said rigid shaft.

8. The sprinkler of claim 7 wherein an opposite end of said rigid shaft is seated in said housing for rotation about a longitudinal axis of said shaft.

9. The sprinkler of claim 8 wherein said rigid shaft is seated in said housing for substantially free spinning rotation.

10. A sprinkler comprising a body portion having a nozzle at one end and a spray plate supported thereon at an opposite end downstream of said nozzle, said spray plate having a plurality of stream distributing grooves formed on one side thereof configured to cause said spray plate to rotate when struck by a stream emitted from said nozzle; and wherein said spray plate includes a flexible connector coupling said spray plate to a free end of a first rigid shaft seated in a housing at said opposite end downstream of said nozzle, such that said spray plate is caused to wobble about a common center of motion as it rotates.

11. The sprinkler of claim 10 wherein said body portion is formed at said opposite end downstream of said nozzle with an annular stator surface engageable with an annular rotor surface on an opposite side of said spray plate such that a portion of said rotor surface moves about said annular stator surface in continuous contact therewith as said spray plate wobbles and rotates.

12. The sprinkler of claim 11 wherein said rotor surface slips and rolls on said stator surface such that as said spray plate rotates and wobbles, a random droplet distribution is achieved which enhances uniformity of the wetted area.

13. The sprinkler of claim 10 and including a bearing insert seated within said housing and an annular lip seal secured within said bearing insert, said bearing insert and said lip seal having aligned openings for receiving said first rigid shaft.

14. The sprinkler of claim 10 wherein said flexible connector comprises a rubber tube with a reduced diameter portion intermediate opposite ends thereof.

15. The sprinkler of claim 10 wherein a second rigid shaft projects from said spray plate, and said flexible connector extends between said first and second rigid shafts.

16. The sprinkler of claim 15 wherein said flexible connector comprises a rubber tube.

* * * * *